US008143553B2

(12) United States Patent
DeFranco et al.

(10) Patent No.: US 8,143,553 B2
(45) Date of Patent: Mar. 27, 2012

(54) PORTABLE STERILIZING TOWEL WARMER

(76) Inventors: Matthew DeFranco, Rockaway, NJ (US); Michael Peters, Glen Rock, NJ (US)

( * ) Notice: Subject to any disclaimer, the term of this patent is extended or adjusted under 35 U.S.C. 154(b) by 215 days.

(21) Appl. No.: 12/379,342

(22) Filed: Feb. 19, 2009

(65) Prior Publication Data

US 2010/0206862 A1 Aug. 19, 2010

(51) Int. Cl.
*H05B 1/00* (2006.01)
*A47B 3/04* (2006.01)

(52) U.S. Cl. ..... 219/201; 219/385; 219/400; 219/391; 219/394; 312/236

(58) Field of Classification Search ..... 219/201, 219/385, 400, 391, 394; 312/236
See application file for complete search history.

(56) References Cited

U.S. PATENT DOCUMENTS

2008/0173631 A1 * 7/2008 Gagas et al. ..... 219/400

FOREIGN PATENT DOCUMENTS

KR 2008006326 * 1/2008

* cited by examiner

*Primary Examiner* — Shawntina Fuqua

(57) ABSTRACT

The present invention comprises a portable apparatus for warming and sterilizing a towel or other fabric article. Provided is an enclosure having at least five sides an opening at the top and means for using the unit in either a free standing or hanging configuration. The present invention is formed of lightweight heat resistant material, the invention's overall size is only slightly larger than that of a standard bath towel, and moreover, the overall size and weight of the device are conducive to travel and allow the unit to be stored compactly under a bed or in a small closet when not in use. The device features a door, a pivoting towel support with integrated heating means and a sterilizing means.

3 Claims, 7 Drawing Sheets

PORTABLE STERILIZING TOWEL WARMER

The present invention relates to towel warmers and more particularly to portable sterilizing towel warmers.

BACKGROUND OF THE INVENTION

Warm and sterile towels are more than just creature comforts in the modern world; they have therapeutic as well as medicinal value. While it may be merely desirable to have a warmed towel available after bathing or showering, a warm and sterilized towel could be an absolute necessity in a medical environment. It is well known that a warmed towel serves to offset the chilling effect due to evaporation of water from the body after showering, even at normal room temperatures.

From the user's perspective, the feel of a warm towel against the skin immediately after a shower or a bath is a delight. If the experience is enjoyed in one's home, it is usually because one has managed to complete a shower shortly after having run a load of towels through the dryer. Today's typical dryers do not have a sterilizing feature. So although a warm towel may feel good on the skin it may be serving as a vehicle for germs. It is impractical for dryers to have a sterilizer because even if a towel were sterilized it would have to be stored in a sterile environment until needed. Clearly this would be impractical. Having a sterilized towel handy outside of a hospital environment is rare, some first aid kits contain sterilized gauze and bandages but these are not warm nor do they cover the same skin area as that of a towel.

With the rise of antibiotic resistant bacteria, flesh eating bacteria and other pathogens, cleanliness is of the utmost importance. Sterilizing a towel is the best way to ensure that there are no pathogens on surface that is going to be in direct bodily contact. If a towel contaminated with a dangerous virus or bacteria came in contact with several individuals the potential for the spread of disease is greatly increased. The pleasant soothing feeling that a warm towel provides after a bath or shower is positive reinforcement to a user to continue using warmed towels on a regular basis. By combining a sterilizing feature, a user will benefit from a clean sterile towel free of dangerous bacteria and other pathogens. Unfortunately, at this time there are no devices that both warm and disinfect towels that are designed for the home market.

Furthermore, it would be advantageous to have a device that would not only warm and sterilize a towel but was also portable and could be easily transported. A lightweight device that an individual could carry and take on an airplane that was no larger than a small suitcase would be the optimal solution.

At this time there are no devices available to the public that provide such portability. Today, only hospitals and well stocked medical facilities have the means to provide warm sterile towel to patients. Environments outside of hospitals may provide warm towels but they usually have not been sterilized. There is no provision at this time for portable convenient means for providing warm and sterile towels. A heating device should be capable of warming uniformly through several layers of towel over a period of a few minutes.

While a number of apparatus have been proposed for this purpose, all of them have many disadvantages. These disadvantages include complexity, expense, permanent installation as well as the inability to satisfactorily sterilize a towel or other fabric article. Prior art towel warmers have hung a single section of a towel in front of a blower so that warm air is directed against one side of the towel. Such warmers generally rely on relatively slow heat conduction from one side of the towel to the other to thoroughly warm the towel. Other warmer have placed a heating element within a perforated support mounted in housing. However, in such warmers, no provision has been made for forcing air to flow over the towel from within the towel support or around the support within the housing. As a result, the warming is relatively slow and uneven.

Other towel-warming devices utilize a system of racks that have rods for hanging a draped towel under a hood. A blower mounted in the hood above the towel blows air downwardly over the outside of the towel.

Yet in another variation, a towel is hung freely from a bar of the support, a blower-heater below the towel directs warm air upwardly across the freely hung towel. The disadvantage of all such devices is obvious, all of these devices are intended to be permanently mounted on the floor or installed in the wall of an existing bathroom. Clearly this is not a portable solution.

In the past there have been portable towel warmers introduced. For example, U.S. Pat. No. 4,918,290. This device includes a rigid cabinet, an electrically operated heater, perforated means for supporting the towel, and means for exhausting heated air. The disadvantage of this device is relative complexity, noise produced by blower and considerable weight and size. Furthermore, this device has no provision for sterilization. While a towel may have been warmed, the device itself may be responsible for spreading disease; lastly this device still requires considerable space for storage.

Nothing in the art discloses a device that could have practical applications at a disaster relief site, temporary hospital or even a traveler's hotel room. All of the aforementioned devices suffer from shortcomings that make them unacceptable for the purposes of a portable sanitary towel warmer in either normal use or in emergency situations. Natural disasters, terrorism and other cataclysmic events dictate the need for a device that is portable and can efficiently warm and sterilize a towel.

BRIEF SUMMARY OF THE INVENTION

The present invention is directed to a portable apparatus for warming and sterilizing towels. The present invention is embodied in the form of a compact lightweight, heat resistant, portable enclosure that can quickly heat and sterilize a towel or other small fabric article. The overall dimensions of the device are not much larger than that of a standard bath towel itself. When not in use the device may be stored under a bed or in a small closet.

The device's enclosure is formed with five sides surrounding an aperture at the top. Within the back wall of the enclosure is formed a series of apertures. One of the apertures forms an integral carrying handle for the present invention while the other apertures are intended for use as means of hanging the present invention on a door, wall or other vertical surface. This is one of the multiple use configurations available to the present invention.

The embodiment provided herein further discloses a door being hingedly affixed to the enclosure, a heating element, a sterilizing element and a pivoting towel support being disposed within the enclosure. The heating element is provided as means to heat a towel or other fabric article while the sterilizing element is provided as a means of sterilizing a towel or fabric article. The pivoting towel support plate is provided inside the enclosure for supporting a towel during the heating and sterilizing process. The pivoting feature of the towel support works in cooperation with the enclosure to facilitates easy insertion and extraction of a towel or fabric article. In at least one embodiment of the present invention disclosed herein, a heating element is incorporated within the pivoting towel support.

The present invention provides means for a plurality of use configurations including standing upright, lying down and hanging vertically. During upright use the enclosure is supported in a vertically position by a plurality of removable supports. These supports are removably affixed to the bottom of the enclosure and allow the invention to be deployed while standing on the ground, a floor or other flat surface. The supports are easily removed when the invention is being stored or in traveling.

DETAILED DESCRIPTION OF THE PRESENT INVENTION

While the following detailed description describes at least one embodiment of the present invention, it is to be understood that the invention is not limited in its application to the details of construction and arrangement of parts illustrated in the accompanying drawings since the invention is capable of other embodiments and of being portrayed in various ways. Furthermore, those skilled in the art will appreciate that the present invention may be practiced in more than those embodiments described herein.

The present invention described herein is directed to portable towel warmers and more specifically to portable towel warmers that are also sterilizers. The present invention is intended to be used by everyone, from the average consumers in the home or traveling to medical personal at makeshift hospitals and disaster relief sites. The benefits provided by the present invention are numerous, including but not limited to, preventing the spread of disease by disinfecting towels and other fabric articles, providing a user with an enjoyable warming experience when removing water from the skin and allowing a user to bring that enjoyable experience with them where ever they travel.

Figure 1:
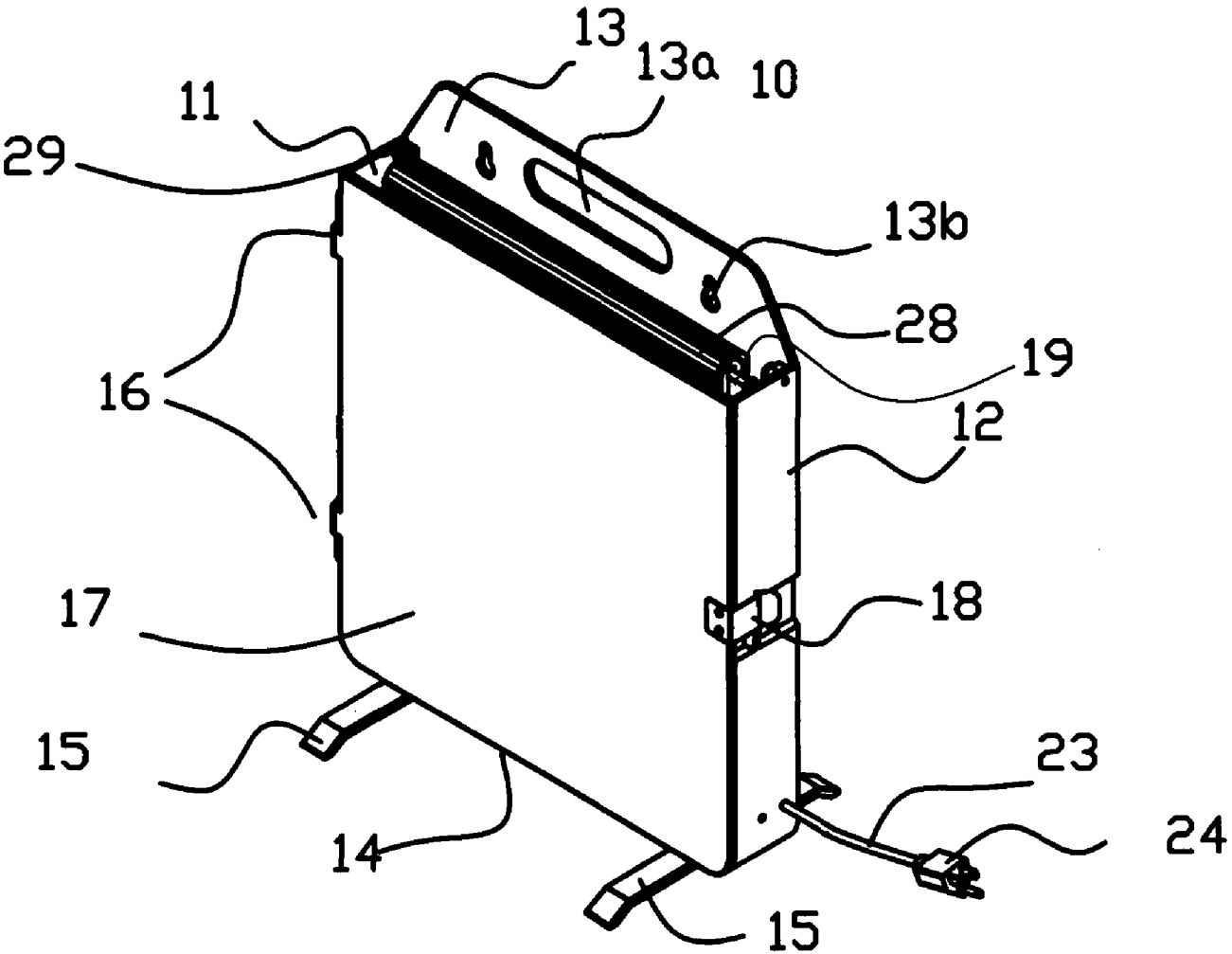
FIG. 1 is a perspective view of a portable sterilizing towel warmer in accordance with one embodiment of the present invention.

Referring now to the drawings; FIG. 1 shows a perspective view of an embodiment of the device according to the present invention. Depicted in FIG. 1 is a vertically upright enclosure 10 formed from five sides. The sides include a rear portion 13, a set of sides 11 and 12 respectively, a bottom 14 and front portion, which in this embodiment, is also a door 17. The enclosure 10 is formed from a strong lightweight heat resistant material that is also ultraviolet safe; the materials the enclosure 10 may be formed from include but are not limited to aluminum, acrylic, polycarbonate, nylon and Invar.

Further depicted in FIG. 1 is an aperture 29 disposed at the top of the enclosure 10. The aperture 29 allows for the escape of steam during the heating and sterilizing process. The top of a towel 28 is depicted cresting the mouth of the aperture 29 and is being supported by a pivoting towel support plate 19. At the other end of the enclosure 10 are a set of feet 15 that are removably affixed to the bottom 14. The feet 15 can be removed for storage, travel or if the unit is intended to be used in a wall hanging configuration.

Figure 2:
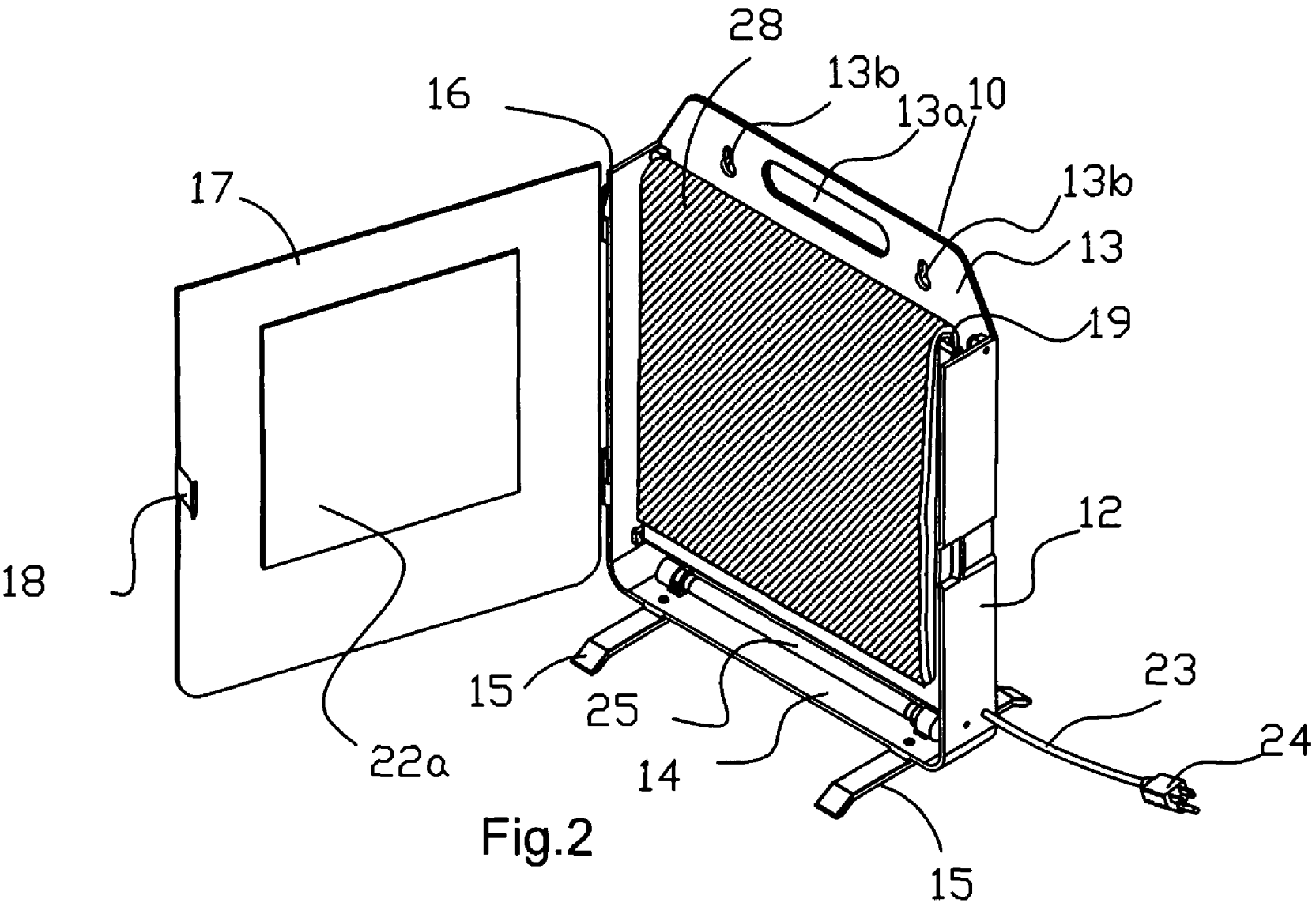
FIG. 2 is a perspective view of a portable sterilizing towel warmer in accordance with one embodiment of the present invention with its door open and a towel inserted.

Attached to the front of the enclosure 10 is a door 17. In this embodiment of the present invention the door 17 is the front of the enclosure 10, it should be noted that the inventors contemplate other embodiments wherein the door would include a separate frame (not shown). In the alternate embodiment, the frame (not shown) would form the front of the device and a door would be disposed within it. The door 17 of the present invention is hingedly affixed to the enclosure 10 by a set of hinges 16. The hinges 16 are affixed to one side 11 of the enclosure 10. The hinges 16 allow the door 17 to swing outward away from the enclosure 10. FIG. 1 depicts the door 17 in the closed position while FIG. 2 depicts the door 17 in the open position. The door 17 opens in order to allow a user access to the internal area of the enclosure 10.

Also depicted in FIG. 1 is latch 18. The latch 18 is affixed to door 17 and is provided to engage enclosure 10 as a means of holding said door 17 securely against said enclosure 10. The specific latching means 18 employed and depicted in this embodiment is that of a simple tension based latch composed of bent spring steel. The inventors contemplate many other latching means including but not limited to: magnetic latch, hook and loop fasteners, mechanical locks, friction catches and ball detent catches.

FIG. 1 further depicts a series of apertures, 13*a* and 13*b*, formed in the rear portion 13 of the enclosure 10. Referring first to aperture 13*a*, this aperture is formed to create a functional integrated carrying handle for the present invention. The aperture 13*a* allows a user to pick up the apparatus and carry it with them where ever they go. This is a portability feature and is additionally enhanced both by the size and weight of the apparatus. The enclosure 10 is not much larger than a standard towel and because it is formed of lightweight materials its overall weigh is inherently light. The second group of apertures is the set noted as 13*b*. FIGS. 1 though 8 according to present invention depict two inverted keyhole style apertures 13*b* however the inventors have contemplated numerous styles and shapes of wall mounting apparatus which may be mixed and matched accordingly to various embodiments of the present invention.

The two apertures, noted as 13*b*, are formed in the shape of inverted keyholes; these are disposed in the rear portion 13 of the enclosure 10. They are formed completely through the material and set equidistantly apart on a parallel axial line with the plane of the bottom 14 of the enclosure 10. This aperture 13*b* arrangement aids the user by allowing them to hang the enclosure 10 in a level attitude with relative ease. The user need only place a level line against a wall or other vertical surface and the user can hang the enclosure 10 quickly and accurately. The inverted keyhole shape of the apertures 13*b* is designed to be placed over a screw head and slid down in order to capture the head of the screw thus providing a mechanical lock.

The light weight and small size of the present invention once again benefits the user. Because of the small enclosure 10 size, relatively little wall space is taken up, furthermore, because of the relatively light weight the invention, the enclosure 10 can be hung on modern gypsum board walls, commonly referred to as "drywall", with simple nails or screws alleviating the need for special provisions such as expanding drywall fasteners, commonly referred to as "molly bolts". After being hung on a wall, the unit can be removed at a whim and transported elsewhere without leaving significant damage or scarring to the wall.

Lastly, FIG. 1 depicts a cord 23 terminated by a plug 24. The inventors have disclosed and depicted in this embodiment a conventional power source means for powering the heating and sterilizing features of the present invention. In this embodiment of the present invention's power is supplied by a common 115 Volt/60 Hertz electrical connection. It should be noted however that the inventors also contemplate other means of supplying power to the present invention; these means include but are not limited to solar, microwave, rechargeable batteries, fuel cell, and hand crank electric generation, the latter being especially useful in lesser developed countries.

FIG. 2 is a perspective view of one embodiment in accordance with the present invention. This figure depicts the enclosure 10 with the door 17 open. Opening the door 17 allows access to the internal area of the enclosure 10 and its various and sundry components. As depicted in FIG. 2, upon opening the door 17, an entire towel 28 supported on a towel support plate 19 is now revealed along with a sterilizing lamp 25. The sterilizing lamp 25 is shown affixed to the bottom 14 of the enclosure 10. In this embodiment the sterilizing lamp 25 is an ultraviolet lamp commonly used for sterilizing and disinfecting. Other means of sterilizing may be used and are contemplated by the inventors of the present invention, these include but are not limited to; radiation, laser, and ultrasonic sterilization.

The internal area of the enclosure 10 is coated with a reflective coating that helps propagate the sterilizing rays emitted by the sterilizing lamp 25. During use, sterilizing rays emitted from the lamp 25 reflect all along the inner surfaces of the enclosure 10 and bathe the towel 28 in germicidal light killing germs and bacteria.

Also shown in FIG. 2 is door mounted heating element 22*a*. This heating element 22*a* is one of three heating elements 22*a*, 22*b* and 22*c* (shown in FIGS. 3 and 4). This heating element 22*a* provides heat to the front surface of the towel 28 and helps warm the towel to a comfortable temperature quickly and efficiently, at this point in the reading it may be useful for the reader to view FIGS. 3 and 4 simultaneously for clarity.

Figure 3:
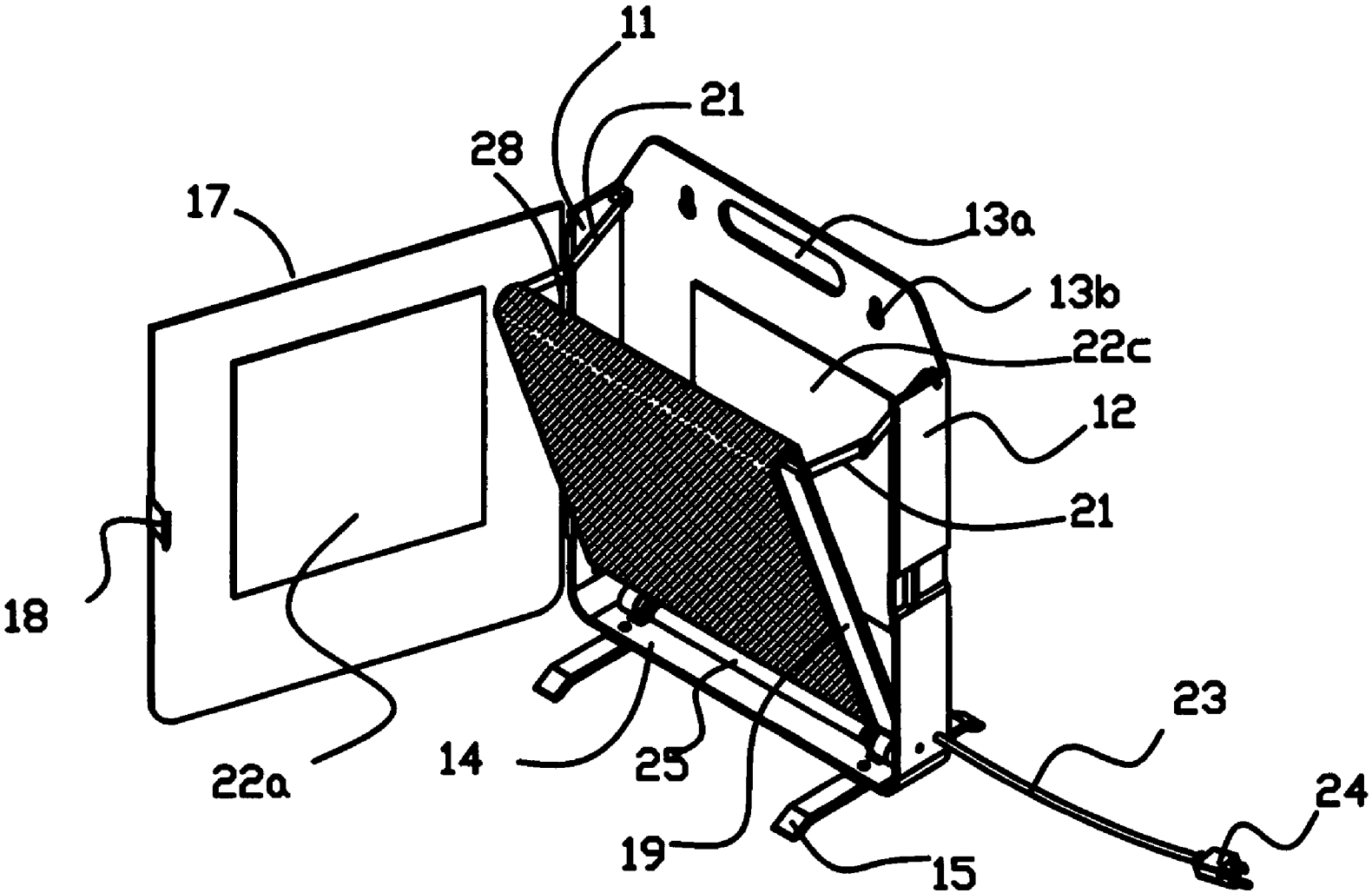
FIG. 3 is a perspective view of a portable sterilizing towel warmer in accordance with one embodiment of the present invention with its door is open and towel ready to be removed.

FIG. 3 is a perspective view of a portable sterilizing towel warmer in accordance with one embodiment of the present invention depicting the door 17 in the open position and a towel 28 provided on a pivoting towel support plate 19. The pivoting support plate 19 is shown in the extended position which facilitates the insertion or removal of a towel 28. Also shown in FIG. 3 is a pair of extending linkages 21 that are connected between the enclosure 10 and the pivoting towel support plate 19. The linkages 21 act to limit the travel of the pivoting support plate 19. Additionally seen in FIG. 3, is heating element 22*c* which is shown disposed on the interior of the rear portion 13 of the enclosure 10.

Figure 4:
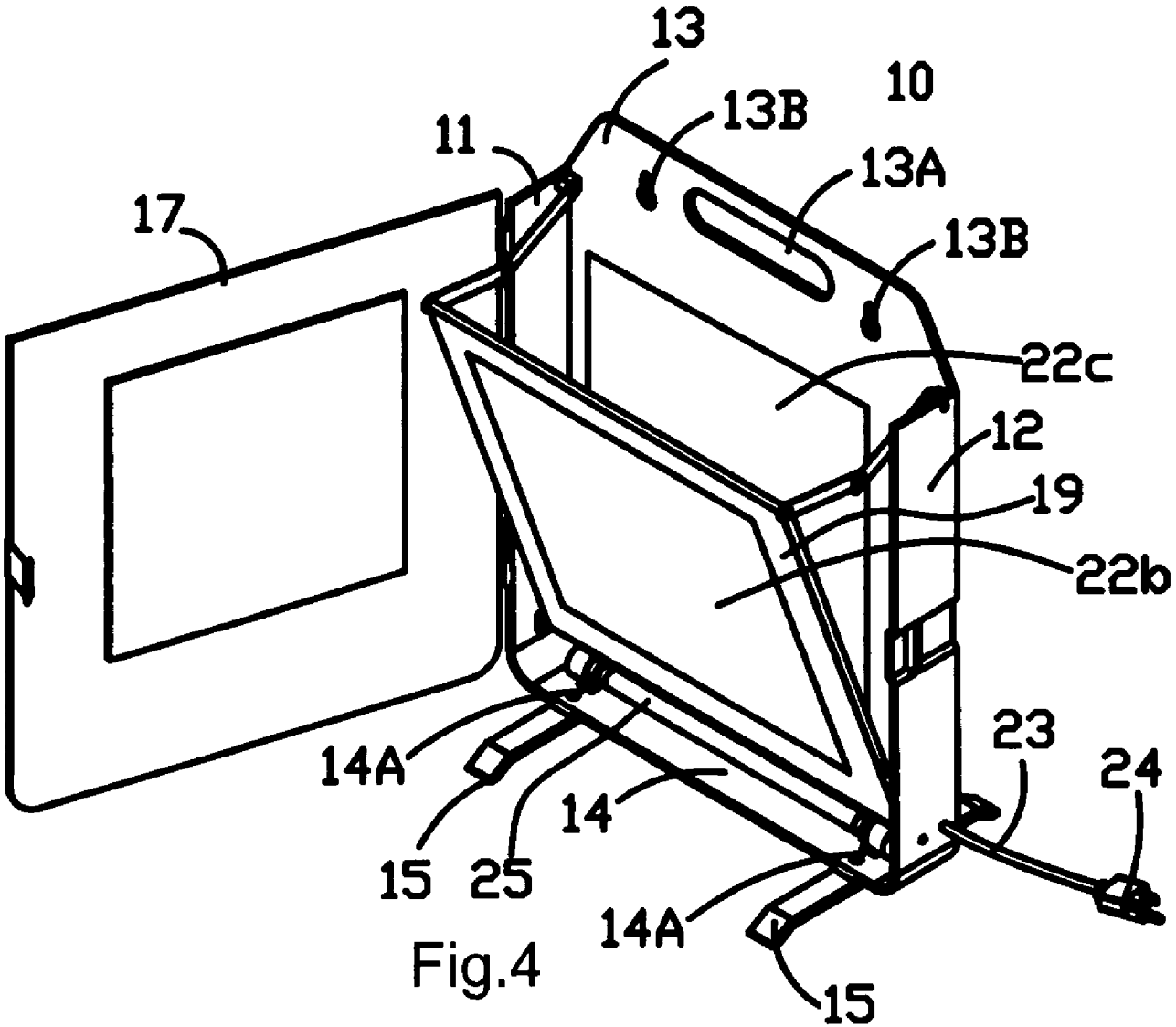
FIG. 4 is a perspective view of a portable sterilizing towel warmer in accordance with one embodiment of the present invention with the towel removed.

FIG. 4 is a perspective view of a portable sterilizing towel warmer in accordance with one embodiment of the present invention. This figure differs from the previous figure in that the towel 28 (as shown in FIG. 3) has now been removed from the towel support plate 19. This figure reveals the dual sided towel support plate integral heating element 22*b*. For the sake of brevity, this element will herein be referred to as the integral heating element 22*b*. The integral heating element 22*b* radiates heat on both sides of the towel support plate 19. This allows heat to be distributed to all of the sides of a towel that are in contact with the towel support plate 19. Heating elements 22*a*, 22*b* and 22*c* all work collectively in concert to quickly and efficiently heat the maximum amount of a towels surface area all at once.

In operation, the door 17 of the invention is opened; the towel support plate 19 pulled forward at its top causing it to pivot from the pivot point 20 at the base. The towel support plate 19 rotates in an arc a distance for the rear portion 13 of the enclosure 10. The towel support plate's arc motion is arrested by the folding pair of linkages 21. A temporary space is now formed between the towel support plate 19 and the rear portion 13 of the enclosure 10. The user then places a towel on the towel support plate 19 such that it is equally divided over the towel support plate 19. Then the user raises the towel support plate 19 which acts to fold the linkages 21 into the enclosure 10. Once the towel support plate 19 is in the upright vertical position, the user closes the door 17 and engages the latch 18 to the side 12 of the enclosure 10 in order to prevent the door 17 from opening during use. The unit is then automatically activated by a sensor (not shown) and all three heating elements 22*a*, 22*b* and 22*c* respectively, instantly heat up and begin to radiate heat into the towel 28. At the same time, the sterilizing lamp is also activated. Within a few seconds the towel 28 is very warm to the touch, completely sterilized and ready for use. The sensor determines the temperate of the towel and automatically shuts the unit off in order to prevent overheating.

It should be noted that the inventors contemplate various means to activate and shut off the present invention. While an automatic electronic sensor was disclosed for the above embodiment, a wealth of mechanical, electrical and electronic actuator and timing means both manual and automatic are also contemplated by the inventors. These include but are not limited to; infrared heat sensors to detect optimal temperature reached, mechanical timers, electronic timers, web based control (both manual and automatic) and microcontroller slaved sensors designed to prevent overheating and automatically shut off. Finally, it should be noted that the inventors have contemplated that the invention can be used with many sizes of towels and bath sheets the largest of which is only limited by the size of the enclosure 10.

As with any device intended for use by the consumer, safety is of the utmost importance. The present invention also utilizes a temperature limiting switch (not shown) which is provided to prevent overheating of the unit thus protecting the unit from premature burnout and potential fire hazard.

Figure 5:
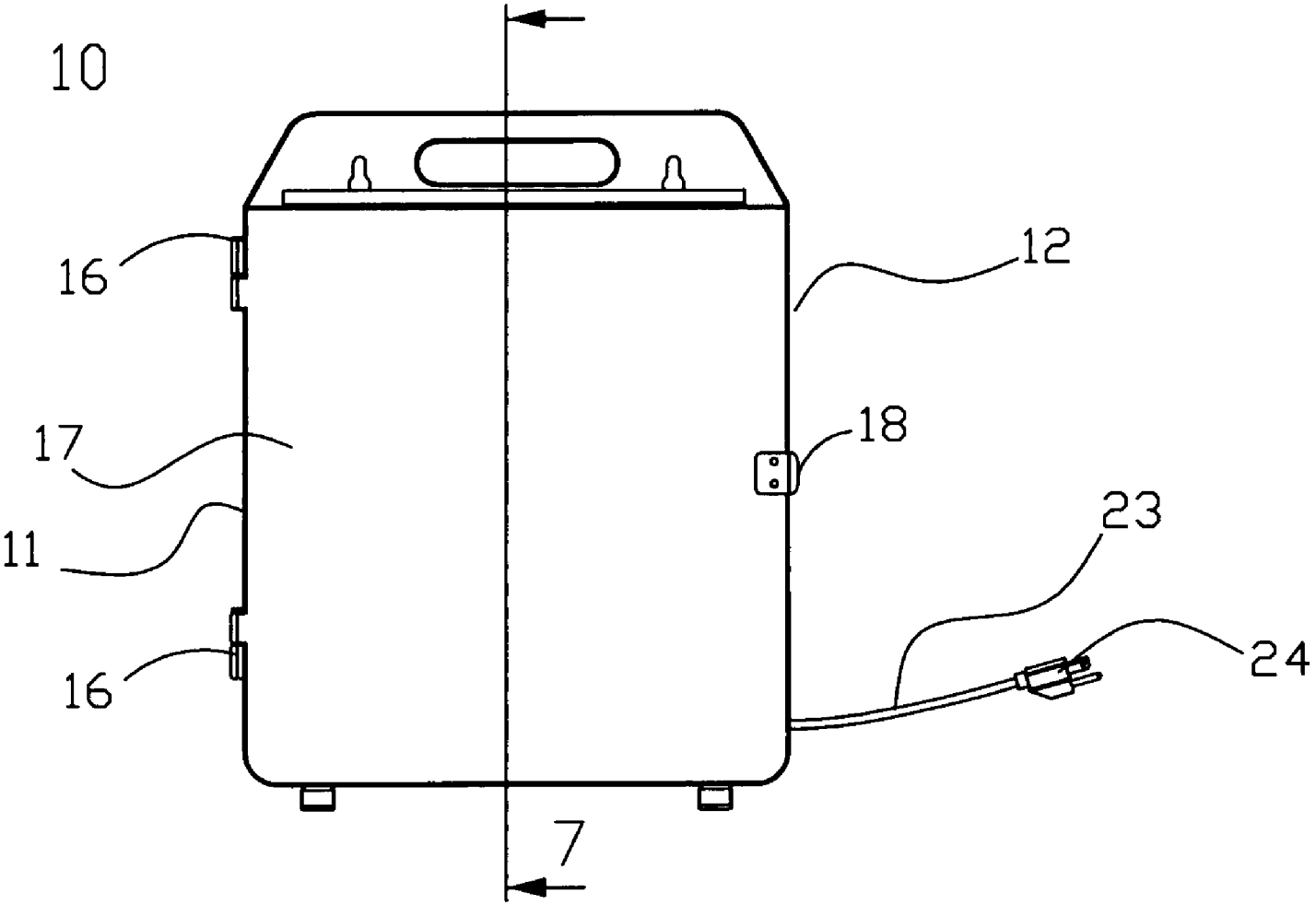
FIG. 5 is a front view of a portable sterilizing towel warmer in accordance with one embodiment of the present invention.
Figure 6:
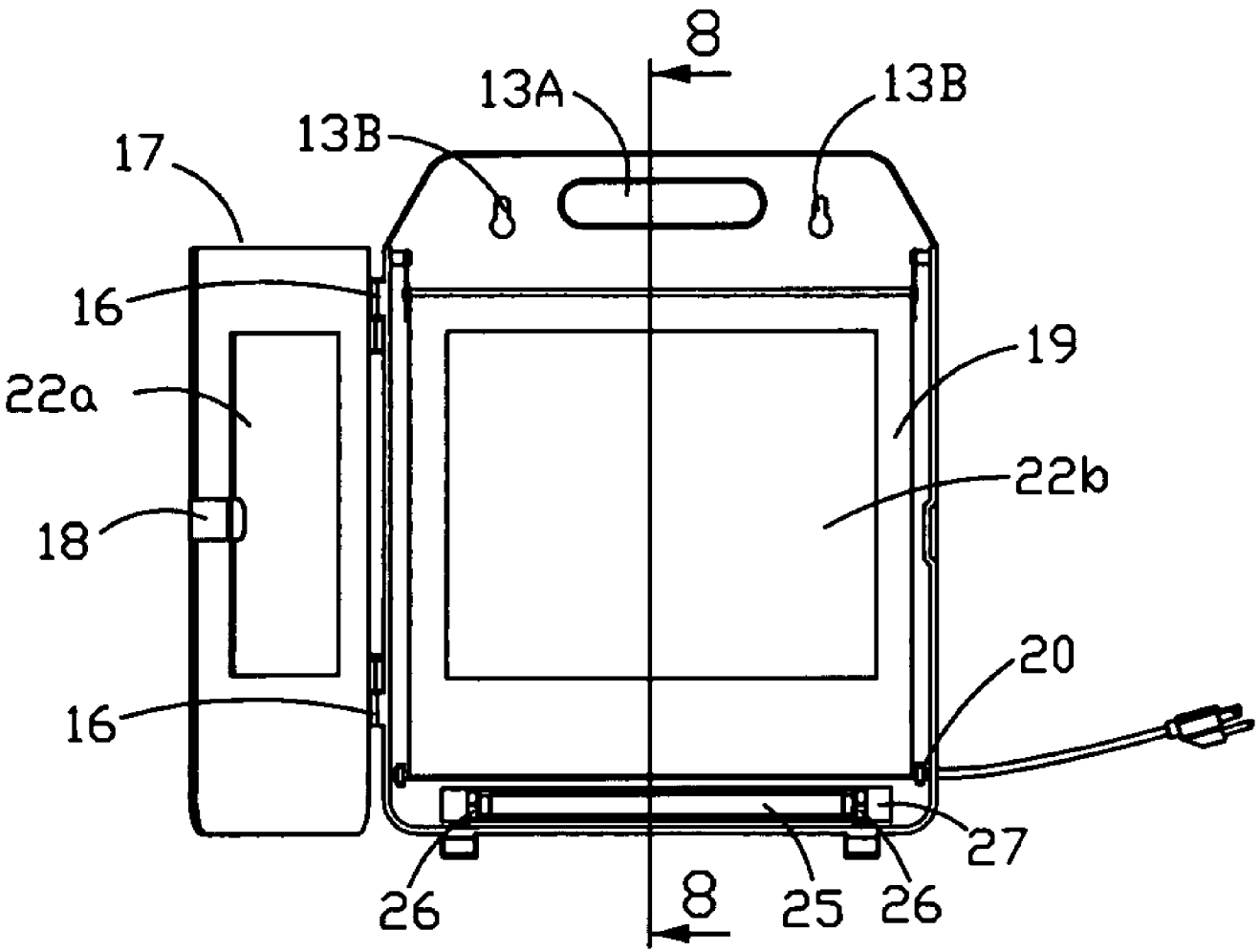
FIG. 6 is a front view of a portable sterilizing towel warmer in accordance with one embodiment of the present invention with the open door and towel support in position to accept the towel.

At this point the reader may find it useful to refer to FIGS. 5 and 6 simultaneously. FIGS. 5 and 6 depict frontal plan views of a portable sterilizing towel warmer in accordance with one embodiment of the present invention. FIGS. 5 and 6 reveal additional feature and components of the present invention either for the first time or more clearly than in previous drawings.

The plan view depicted in FIG. 5 of the drawings illustrates the present invention with the door 17 in the closed position. Also displayed are the hinges 16 and the latch 18 which is affixed to the door 17. The hinges 16 disclosed in this embodiment of the present invention are integral hinges, one half of the simple hinge 16 is formed from rolled extensions of the door's material and the other half of the hinge 16 is formed from that of material on the side 12 of the enclosure 10. These simple hinges 16 function to serve a dual purpose, they allow the door 17 to open and close freely and they help reduce overall weight of the apparatus thus enhancing the portability feature of the invention. While an integral hinge 16 is illustrated, the inventors have contemplated utilizing many types of hinges for the present invention. These include but are not limited to: continuous piano type hinges, recessed hinges, detachable hinges and hinges formed from flexible materials. Further illustrated by FIG. 5 is the integral carrying handle 13*a*, the oval shape allows a users hand to easily grasp the enclosure 10 and helps to reduce the overall weight of the invention. Also depicted are the two apertures formed in the shape of inverted key holes 13*b* for use in hanging the present invention on a wall, a sectioning line 7-7 (refer to FIG. 7 to view the sectioned drawing), and electric cord and plug, 23 and 24, respectively.

FIG. 6 is a front plan view of a portable sterilizing towel warmer in accordance with one embodiment of the present invention depicting the door 17 open and the towel support plate 19 extended. Clearly shown is the pivot point 20 of the present invention. This pivot point 20 allows the top of the towel support plate 19 to rotate outward and away from the rear portion 13 of the enclosure 10. FIG. 6 also clearly illustrates the sterilizing lamp 25 and its associated support components 26 and 27. 26 is the sterilizing lamp socket, hereinafter referred to as the socket 26, 27 is the sterilizing lamp socket holder, hereinafter referred to as socket holder 27. The sterilizing lamp 25 employed by this embodiment of the present invention is of the ultraviolet lamp type commonly used in medical sterilizing devices designed to kill germs and bacteria. FIG. 6 also shows a sectional 8-8 which refers to the sectional representation of the drawing and is presented as FIG. 8.

Figure 8:
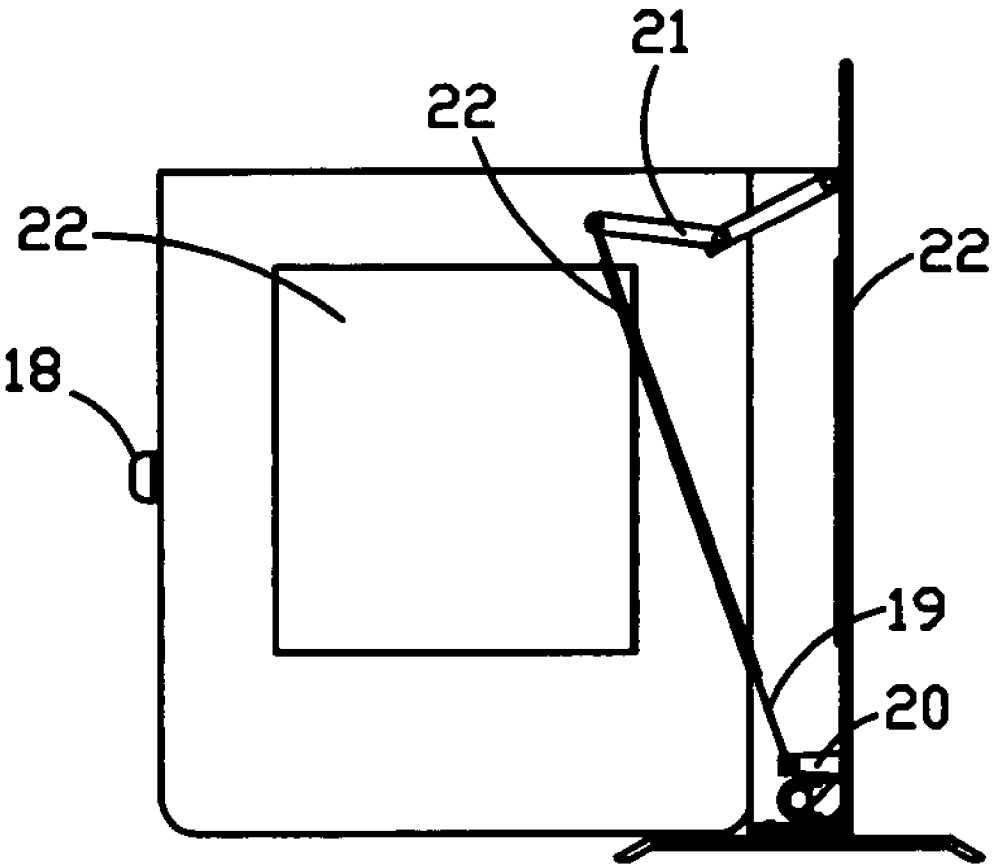
FIG. 8 is a sectional side elevation taken through line 8-8 of FIG. 6.
Figure 7:
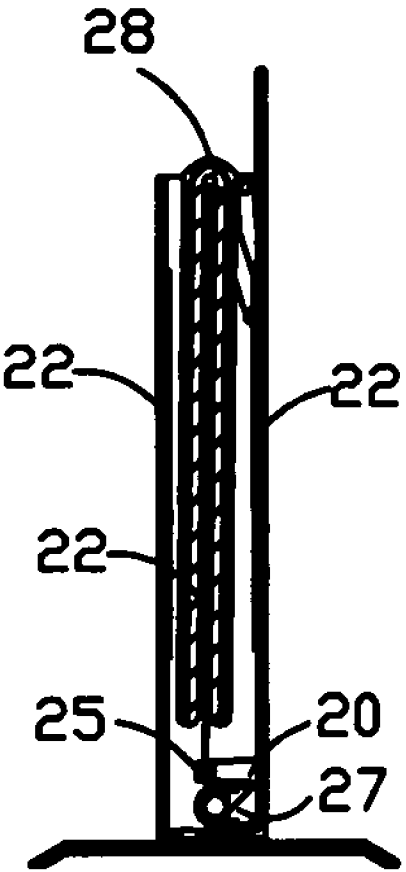
FIG. 7 is a sectional side elevation taken through line 7-7 of FIG. 5.

At this point in the reading the reader may wish to view FIGS. 5, 6, 7 and 8 simultaneously for greater clarity. As previously noted, FIG. 7 is a cross sectional representation of FIG. 5 taken along lines 7-7 while FIG. 8 is a cross sectional representation of FIG. 6 taken along lines 8-8.

FIG. 7 illustrates how a towel 28 is supported by the towel support plate 19 and the towels 28 proximity to the heating elements 22*a*, 22*b*, and 22*c*, and the relation of the towel 28 to the sterilizing lamp 25. This figure also serves to show the compactness and slim design of the present invention.

Lastly, FIG. 8 shows the cross section of the present invention with the door 17 open, the towel support plate 19 pivoted outward away from the rear portion 13 of the cabinet 10, and the linkages 21 extended. In this figure there is no towel 28 on the towel support plate 19. It is worth noting that all of the figures disclose the present invention as configured to operate as standing on a flat horizontal surface. This configuration is denoted by the appearance of the removable supports 15 which are depicted in the drawings as affixed to the enclosure 10.

The forgoing detailed description is to be understood as being in every respect illustrative and exemplary, but not restrictive, and the scope of the invention disclosed herein is not to be determined from the detailed description but rather from the claims as interpreted according to the full breadth permitted by the patent laws. It is to be understood that the embodiment shown and described herein are only illustrative of the principals of the present invention. Those skilled in the art could implement various other feature combinations without departing from the scope and sprit of the invention.

What is claimed is:

1. A portable sterilizing towel warmer comprising:
an enclosure having an opening,
a door in communication with said enclosure,
at least on heater disposed within said enclosure,
at least one sterilizer disposed within said enclosure,
a towel support plate disposed with said enclosure,
a plurality of supports removably affixed to the exterior of said enclosure,
a reflective coating disposed within the interior of said enclosure and on the inside portion of said door,
a plurality of apertures formed within said enclosure for use in hanging the invention on a wall or other vertical surface,
wherein said plurality of apertures are formed in the shape of inverted keyholes, and
wherein said sterilizer is an x-ray radiation source.

2. The portable sterilizing towel warmer of claim 1 wherein said enclosure is made of an ultraviolet light filtering transparent material.

3. The portable sterilizing towel warmer of claim 1 wherein said enclosure is made of an ultraviolet light filtering translucent material.

* * * * *